US005720625A

United States Patent [19]

Albeck et al.

[11] Patent Number: 5,720,625

[45] Date of Patent: Feb. 24, 1998

[54] ELECTRICAL CLAMPING TERMINAL ARRANGEMENT

[75] Inventors: Bernhard Albeck, Lorch-Waldhausen; Herbert Emmerich, Waiblingen-Neustadt; Stefan Koller, Niedertotzingen; Hans-Peter Mews, Lüdensheid, all of Germany

[73] Assignee: Vossloh Schwabe GmbH, Urbach, Germany

[21] Appl. No.: 561,159

[22] Filed: Nov. 21, 1995

Related U.S. Application Data

[63] Continuation of Ser. No. 190,129, Feb. 3, 1994, abandoned.

[30] Foreign Application Priority Data

Jun. 6, 1992 [DE] Germany ..... 42 18 740.0

[51] Int. Cl.[6] ..... H01R 4/24

[52] U.S. Cl. ..... 439/395; 439/404

[58] Field of Search ..... 439/395–404, 439/417–419; 29/866, 867, 865

[56] References Cited

U.S. PATENT DOCUMENTS

| | | | |
|---|---|---|---|
| 2,501,187 | 3/1950 | Oortgijsen . | |
| 2,647,245 | 7/1953 | Gilbert | 439/417 |
| 4,210,999 | 7/1980 | Smith . | |
| 4,679,881 | 7/1987 | Galvin et al. . | |
| 4,723,918 | 2/1988 | Lacroix | 439/397 |
| 5,049,088 | 9/1991 | Rishworth et al. | 439/417 |
| 5,061,203 | 10/1991 | Allgood et al. . | |

FOREIGN PATENT DOCUMENTS

| | | |
|---|---|---|
| 64094 | 5/1971 | Australia . |
| 43949 | 1/1974 | Australia . |
| 58415 | 1/1975 | Australia . |
| 2 333 361 | 6/1977 | France . |
| 32 36 868 A1 | of 0000 | Germany . |
| 22 32 311 C2 | 1/1973 | Germany . |
| 23 14 330 C2 | 10/1973 | Germany . |
| 2 241 518 | 3/1974 | Germany . |
| 57-122687 | 7/1982 | Japan . |
| 59-109073 | 7/1984 | Japan . |
| 2-87379 | 7/1990 | Japan . |
| 3-15465 | 2/1991 | Japan . |
| 2 112 217 | 7/1983 | United Kingdom . |

*Primary Examiner*—David Pirlot

*Attorney, Agent, or Firm*—Frishauf, Holtz, Goodman, Langer & Chick, P.C.

[57] ABSTRACT

An electrical clamping terminal arrangement with an IDC contact located in a housing of insulating material is formed, in particular for use in an automatic wiring, in such a way that the housing, on at least one side adjoining the introduction slit of the IDC contact, has a slitlike or groovelike indentation opening toward the introduction side for the conductor. The dimensions of this indentation are chosen such that a free end, located in the vicinity of the IDC contact, of a line contacted in the IDC contact is received in the indentation in a shock-hazard-proof manner.

16 Claims, 4 Drawing Sheets

ELECTRICAL CLAMPING TERMINAL ARRANGEMENT

This application is a continuation of application Ser. No. 08/190,129, filed Feb. 3, 1994 now abandoned.

FIELD OF THE INVENTION

The invention relates to an electrical clamping terminal arrangement having a housing of insulating material, which has at least one introduction slit, open at the edge toward an introduction side, for an electrical line and at least one cut-clamp or IPC (insulation piercing connection) contact, located in the housing and forming a contacting zone, with an IPC slit open at the edge and aligned with the introduction slit for connecting conductors.

BACKGROUND

For connecting electrical apparatus or components to the lines of a wiring, various connection techniques are presently used (such as screw connection, plug-in connection, soldering, and the IPC method).

Most of the clamping terminal arrangements designed in accordance with these connection techniques require a number of operating steps when the wiring is produced, and these steps must mainly be carried out manually and sometimes demand considerable skill and care on the part of the person who makes the electrical connection. This plays a lesser role as long as the only consideration is to connect a few clamping terminals of an electrical apparatus, as is the case for instance when the apparatus is connected to the mains power system. However, for more-complicated wiring with a number of terminals or in the mass production of identical electrical apparatus, the expenditure of time and material that is necessary to produce perfectly contacted electrical connections gains decisive significance. The complexity of the operating steps necessary to produce the electrical connections in particular makes automatic wiring difficult, or possibly only with very major industrial effort.

Among the conventional connection techniques, what is known as the cut-clamp or IPC (insulation piercing connection) method requires comparatively little labor, because for assembly it requires merely clipping the line and pressing it into the IPC terminal. Clamping terminal arrangements designed in accordance with the basic features of this connection method are known in a number of versions, for which reference may be made for example to French Patent Disclosure 2 330 159, German Utility Models DE-GM 88 04 388, 87 14 703 and 88 12 057, and U.S. Pat. No. 2,501,187, which are the point of departure for the invention, and an article in the journal "Messen+Prüfen/Automatik" [Measurement +Testing/Automatic Systems], July/August 1982, pp. 491 and 492. Of these connection arrangements, designed from the most various standpoints, however, none of them have the functional characteristics that make them suitable for use in fully automatic direct wiring of electrical apparatus or apparatus systems.

THE INVENTION

The object of the invention is therefore to create an electrical clamping terminal arrangement of the IPC type that is designed to be appropriate for automating the direct wiring operation.

Briefly, the clamping terminal arrangement referred to at the outset is characterized, in accordance with the invention, in that the housing has, on at least one side adjoining the introduction slit, a slitlike or groovelike indentation or recess open toward the introduction side, whose dimensions are selected such that a free end of a wire line, located in the vicinity of the IDC terminal element contact is received in the recess or indentation in a shock-hazard-proof manner.

In this electrical clamping terminal arrangement, complete shock-hazard protection for the free end of the conductor is achieved automatically when with the conductor is contacted if the conductor, for instance when the electrical connection is made, is clipped-off next to the IPC terminal. At the same time, the clamping terminal arrangement also enables through-wiring, so that all the conditions are available for fully automatic direct wiring. The introduction slit in the housing may have a width that brings about a clamping fixation of a pressed-in line, which makes it possible to attain, immediately in the contacting process, not only the shock-hazard protection but also tensile stress relief. Since no other steps are needed in making the connection, each terminal needs to be approached by a line-laying tool only once, which is an essential prerequisite for automating direct wiring.

The IPC slit also contributes to this automation of wiring in that it permits a certain height tolerance when the conductor is pressed in. At the same time, contacting of the conductor over a large surface area in a gas-tight manner is assured; on being pressed in, the conductor is immediately contacted in the manner of a cold weld, so that oxidation of the conductor surface, as is often the case if the conductor insulation must first be removed in a separate step, is not possible. The fact that the conductor is clipped directly next to the IPC contact and then automatically protected in a shock-hazard-proof manner with its free end in the slitlike or groovelike indentation makes it possible to work with very short ends, or in other words essentially without any waste. In the case of larger wiring layouts, with many terminals, this leads to a considerable savings of material.

The width of the slitlike or groovelike indentation is in a practical manner greater than the width of the introduction slit. With a view to improving the shock-hazard protection and attaining a very short design of the overall clamping arrangement, it is also advantageous if the slitlike or groovelike indentation is deeper than the introduction slit, so that the free end of the clipped conductor can be bent downward behind the IPC contact toward the base or bottom of the indentation.

In principle, it is possible to provide a groovelike or slitlike indentation of this type on either one or both sides of an IPC contact and to design it in the manner of a channel open at one end. For certain applications, however, it may also be practical to make the arrangement such that the slitlike or groovelike indentation is formed as a chamber, in which the exposed end of the contacted conductor is protected in a shock-hazard-proof manner. In this way, the structural length of the clamping terminal arrangement can be reduced still further. The chamber may be defined on both sides by IPC contacts, each with an associated introduction slit, which makes it possible selectively either to connect and clip two conductors or to use the clamping terminal arrangement merely to connect a single conductor to the right or left, or finally to use it for the through-wiring.

To make automatic introduction of the line easier, the slitlike or groovelike indentation is advantageously provided on the introduction side with a widening, which may for instance be formed by means of introduction bevels. Also, the slitlike or groovelike indentation may have guided faces for a line-laying tool. This design makes it possible to guide the tool exactly positionally correct relative to the IPC slit when the line is introduced and contacted, without requiring additional guiding devices.

If the line is clipped at the particular terminal formed by the clamping terminal arrangement, then this may be done using a knife on the automatic line-laying tool. Another option is that the clamping terminal arrangement includes at least one clipper edge for a line to be pressed into the IPC slit. The clipper edge may be formed on an IPC contact, for instance. It becomes operative when the conductor is pressed in.

The new clamping terminal arrangement may be formed as an independent clamping terminal in a single or multiple clamping version. To that end, the housing may have formed-on securing means. Often, however, it is practical to integrate the clamping terminal arrangement directly with an electrical circuit element, e.g. a base for a fluorescent lamp, by forming the housing onto a part of an electrical circuit element, or forming it as part of such a circuit element.

DRAWINGS

Exemplary embodiments of the subject of the invention are shown in the drawing. Shown are:

FIG. 1, a perspective view of a clamping terminal according to the invention;

FIG. 2, a view from the front of the clamping terminal of FIG. 1;

FIG. 3, a sectional side view, taken along the line III—III of FIG. 4, of the clamping terminal of FIG. 1;

FIG. 4, a plan view of the clamping terminal of FIG. 1;

FIG. 5, a detail, in a sectional view corresponding to FIG. 3 and on a different scale, the line introduction region of the clamping terminal of FIG. 1;

FIGS. 6, 7, sectional side views taken along the lines VI—VI and VII—VII, respectively, of FIG. 5 of the arrangement of FIG. 5;

FIG. 8, a plan view of a modified embodiment of the clamping terminal of FIG. 1;

FIG. 9, in a sectional view similar to FIG. 5, the clamping terminal of FIG. 1 with an IPC contact provided with clipper edges;

FIG. 10, a perspective view of an electric fluorescent lamp ballast with two clamping terminals of FIG. 1;

FIG. 11, in a detail shown in perspective, a capacitor with an associated retainer, with clamping terminal arrangements according to the invention;

FIG. 12, in a perspective view, a lamp base for a rod-like gas discharge lamp with a formed-on clamping terminal arrangement according to the invention;

FIGS. 13, 14, in schematic sectional views similar to FIG. 5, the contacting of the clamping terminal of FIG. 1, showing two successive method steps;

FIG. 15, in a sectional view similar to FIG. 5, the contacted clamping terminal of FIG. 1; and FIG. 16, in a plan view corresponding to FIG. 4, the contacted clamping terminal of FIG. 1, showing the contacted insulated conductor.

DETAILED DESCRIPTION

Figure 1:
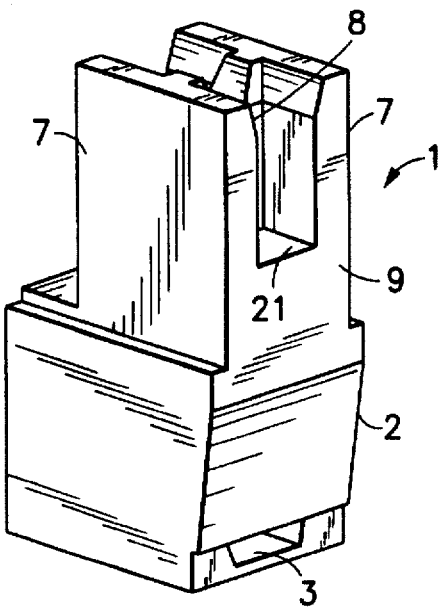
Figure 2:
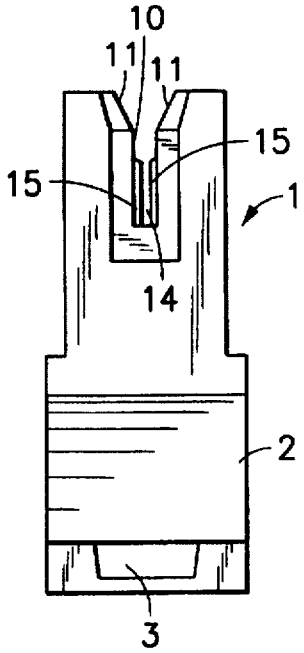

The clamping terminal shown in FIGS. 1–7 has a housing 1 of insulating material and having a substantially rectangular cross section, which is placed on a formed-on base part 2 likewise made of insulating material that is provided with a fastening or securing device in the form of a continuous longitudinal slit 3 located in the vicinity of the flat bottom face. As can be seen from FIG. 3, the clamping terminal is placed with its bottom face on the base plate 4, for instance, of an electrical fluorescent lamp ballast 5 (see FIG. 10) and secured to it by means of a tab 6, notched out of the base plate and bent upward, which protrudes through the longitudinal slit 3.

The two side walls 7 of the housing 1, which is open at the top toward its line introduction side have two opposed ribs 8 on their inside, which are located approximately in the middle between the two end sides 9 of the housing 1 and between them define an introduction slit 10 (FIGS. 2, 4) defined in a slightly wedge-shaped or parallel-sided fashion, which is widened at its top by introduction bevels 11. In its lower region, the introduction slit 10 is widened locally somewhat at 12 (FIG. 6) in in the shape of part of a circle.

Two opposed narrow grooves 13 (FIG. 5) extend from below to approximately the height of the introduction bevels 11 into the ribs 8 and receive the two legs 15, defining an IPC slit 14 open at the edge, of an IPC contact or terminal 16 produced from spring steel or spring bronze. The narrow IPC contact 16, in the shape of a small plate and essentially U-shaped in the region of the IPC slit 14, is embedded on all sides in the insulating material of the housing 1 except for the cut segments formed at the leg 15 and oriented toward the IPC slit 14; both of its legs 15 are guided movably to a limited extent in the grooves 13. In its unslit region adjoining the two legs 15, it is suitably formed at 17 (FIG. 3) and inserted into a groove in the base part 2, in which groove it is also axially supported. The electrical winding of the ballast 5 is connected via a conductor 19, which is received in a molded part 20 of insulating material at the top of the ballast 5 and on its other end is electrically conductively connected to the IPC contact 16. Together with the IPC slit 14, the IPC contact 16 forms the contacting zone of the clamping terminal.

In accordance with a feature of the invention, and as can be seen from FIGS. 1–5, for instance, the housing 1, on both sides of the ribs 8 and hence adjoining the introduction slit 10, has one groovelike indentation or recess 21 each of essentially rectangular or slightly wedge-like-converging cross section, which opens next to the introduction slit 10 toward the introduction side of the housing 1. The two groove-like indentations or recess 21 are located in alignment with one another and with the introduction slit 10. They are likewise defined toward the top by an introduction bevel 22. FIGS. 3–6 show that the depth of the groove-like indentations 21 is greater than the depth of the introduction slit 10, and that their width 23 is also substantially greater than the width of the introduction slit 10.

Figure 15:
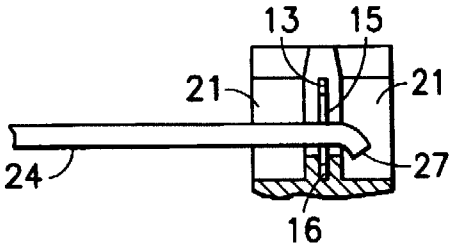
Figure 16:
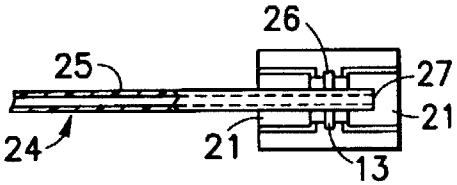

The dimensions of the individual parts are selected such that for an insulated line 24 pressed in through the introduction slit 10 in the manner seen in FIG. 16, the insulation 25 is cut or pierced open in the IPC slit 14 by the legs 15 of the IPC contact 16, and at the same time a gas-tight contacting takes place between the IPC contact 16 and the metal conductor 26 that is deformed at the clamping point. The pressed-in line 24 is simultaneously firmly clamped by its insulation 25 in the introduction slit 10 between the two ribs 8, and the widening at 12 (FIG. 6) serves to assure that the conductor 24 will lock into place in detent fashion at its insulation 25 upon being pressed into the introduction slit 10. The thus-fixed, connected line 24 extends through one of the groovelike indentations or recesses 21, while its clipped end 27 is located in the other groovelike indentation or recess 21, as will be described in further detail in conjunction with FIGS. 14–16. The width 23 and depth of the groovelike indentations or recess 21 and their axial length are dimensioned such that contact protection is automatically produced for the clipped end of the line 24. This means that the standardized sensing prong, in a test for shock-hazard protection, cannot penetrate as far as the cut face, bared and clipped, of the end 27 of the line 24 at the depth of the associated groovelike indentation 21. The metal IPC contact 16 itself is completely protected toward the outside with its legs 15 in the grooves 13 of the insulating material housing 12. It rests at a depth such that even in the region of the introduction slit 10, absolute shock-hazard protection exists.

In the embodiment of the housing 1 described in conjunction with FIGS. 1–7 , two groovelike indentations 21 aligned with one another are provided, one on either side of the introduction slit 10, and their width 23 and depth are substantially larger than the diameter of the line 24 to be received. It is also possible to leave out one of the groovelike indentations 21, which is particularly worth considering if the line 24 is merely being laid continuously through the contacting zone.

Figure 8:
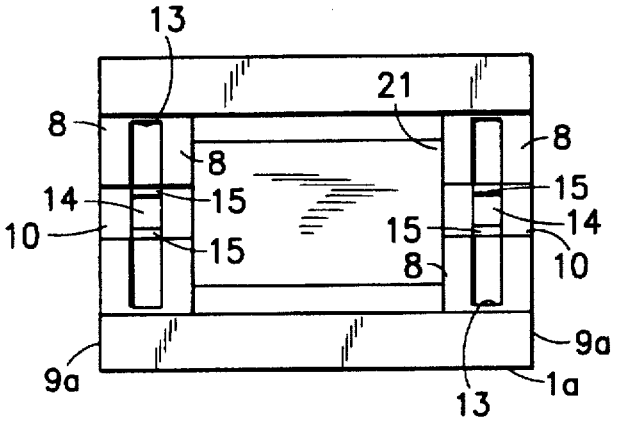

FIG. 8 shows a modified embodiment of the housing 1 in plan view: In this embodiment, only one groovelike indentation 21 is present, which is defined in the housing 1*a* on both sides by one pair 8 of ribs each with an intervening introduction slit 10 and is therefore formed in the manner of an opening chamber. The pairs of ribs 8 are each formed-on flush at the ends with the side walls 9*a* in the housing 1*a* and are aligned by their introduction slits 10 with the longitudinal axis of the groovelike indentation 21.

Figure 3:
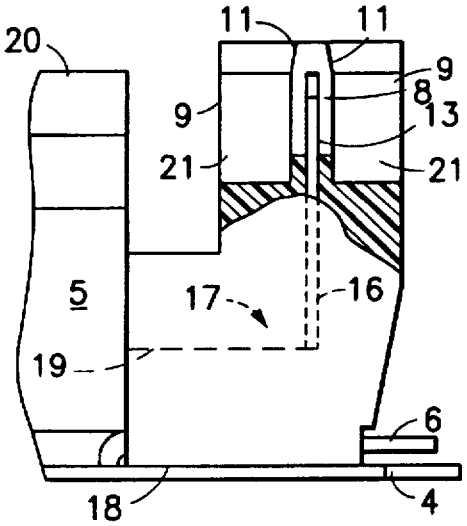
Figure 4:
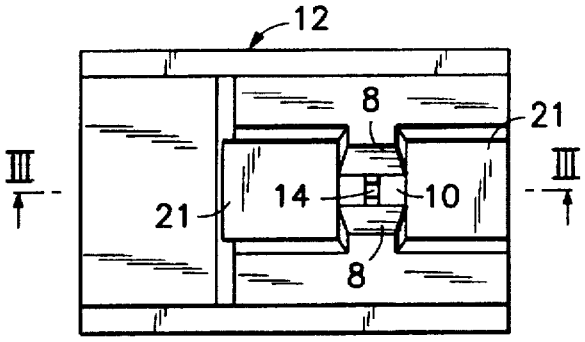
Figure 5:
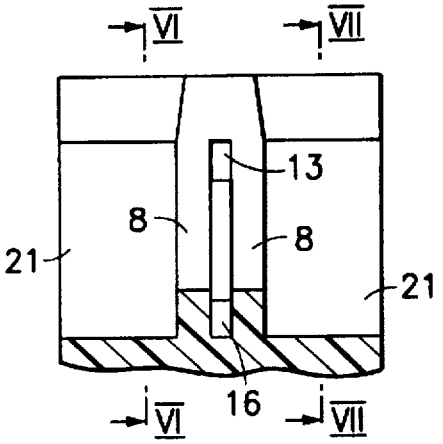
Figure 6:
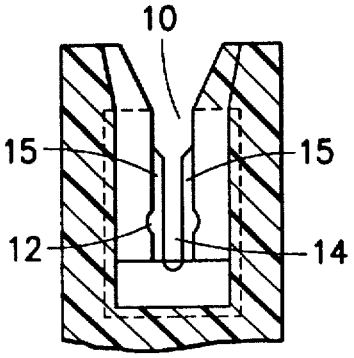
Figure 7:
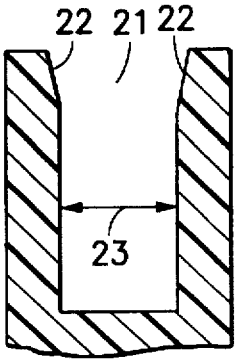

In FIG. 8, in the region of the two introduction slits 10, grooves 13 are formed into each of the corresponding pairs of ribs 8 and in these grooves the legs 15 of two IPC contacts 16 as in FIG. 3 are supported in such a way that they can be spread elastically apart. Each pair of legs 15 defines an IPC slit 14, which is aligned with the associated introduction slit 10. The embodiment of FIG. 8 makes it possible to clip off the contacted conductor immediately in the contacting zone.

In the embodiment described, the IPC contact 16 makes it possible to produce the contact with a pressed-in conductor 26, in the manner illustrated in FIG. 16, for example. If the line 24 is to be clipped off in the region of the contacting zone, then this is done by means of its own tool, as will be described in detail in conjunction with FIGS. 13, 14 below. However, it is also possible, in the housing 1 or 1*a*, to provide at least one clipper edge for a line 24 pressed into an IPC slit 10. Thus as it is pressed in, the line can be simultaneously clipped off.

Figure 9:
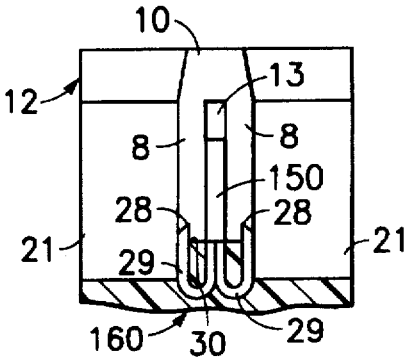

An example of this is shown in FIG. 9:

The IPC contact 160, inserted into a housing similarly to what is shown in FIG. 5, is again supported by its two resilient metal legs 150 in the two grooves 13 such that it is limitedly spreadable. On both sides of the legs 150, however, it has two upward-pointing clipper edges 28, which extend at a slight lateral distance from the legs 150 transversely to the introduction slit 10, on formed-on leg parts 29, bent in a U, of the IPC contact 160. The clipper edges 28 are at a certain distance above the bottom 30 of the introduction slit 10, so that a line 24 pressed in from above through the introduction slit 10, after contacting of its conductor 26 in the IPC slit 14, can finally be pressed downward onto one of the clipper edges 28 and severed there.

In FIG. 9, the two clipper edges are located inside the ribs 8, so that the line 24 remains with its cut face still inside the lateral boundary of the introduction slit 10. In principle, it is also possible to shift the clipper edges 28 laterally somewhat farther away from the legs 150, and it is also possible to associate only a single clipper edge 8 with the IPC contact 160.

Figure 10:
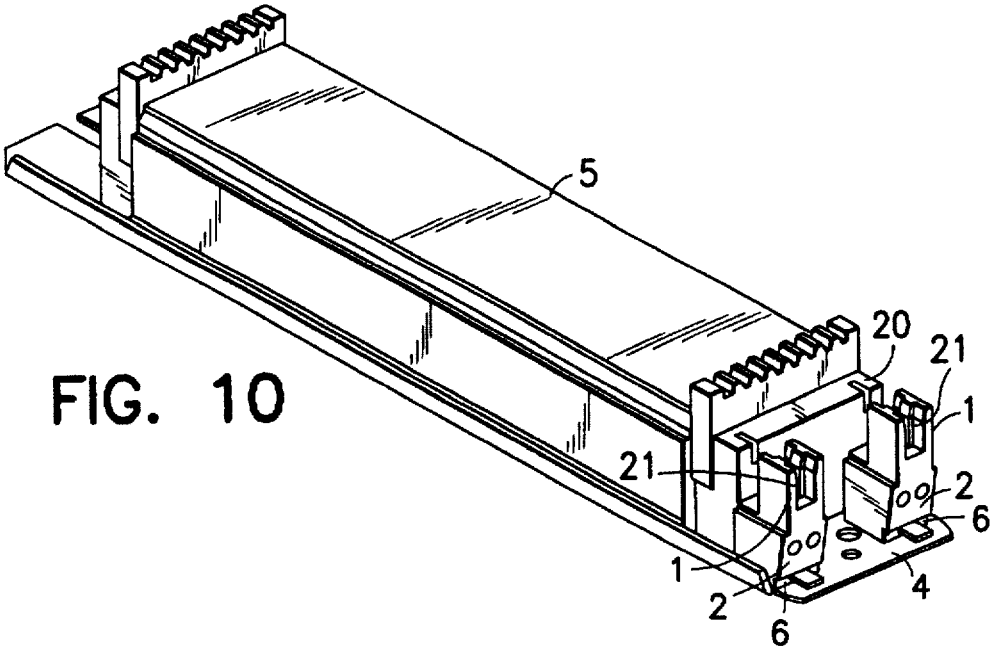

The clamping terminal described in conjunction with FIGS. 1–9 may, as already noted, be associated as an independent clamping terminal arrangement with the most various kinds of electrical equipment, switching elements and apparatus systems, including electric printed circuit boards. An example of this is shown in FIGS. 3 and 10, in which two clamps are located with their housings 1, in the manner already explained, on the base plate of a magnetic ballast choke 5 of a gas discharge lamp.

Figure 11:
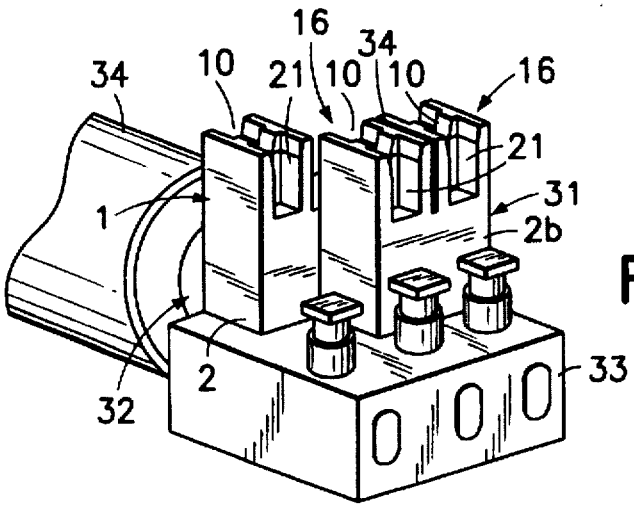
Figure 12:
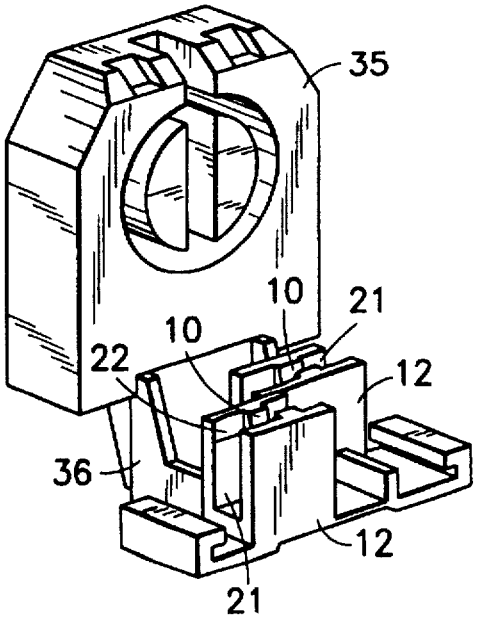
Figure 13:
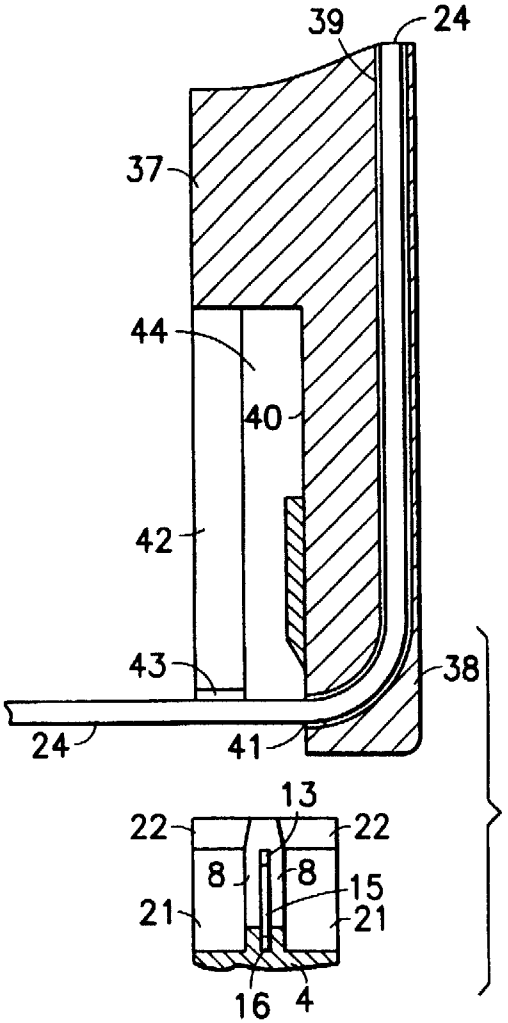

The clamping terminals may also be formed as multiple clamps, as shown in FIGS. 11–13 in the form of a double clamping terminal, which is located jointly with a single clamping terminal 32, similar to the type shown in FIG. 1, on a base 33 of insulating material. A capacitor 34 is secured to the insulating material base 33 and in a manner not shown in further detail is electrically connected to the IPC contacts or to the double clamping terminal 31. The double clamping terminal 31 has fundamentally the same structure as the clamping terminal described in conjunction with FIGS. 1–7, except that now two such clamping terminals are combined to make one unit, the two housings 1*b* of which are separated from one another by a slit 34 that extends somewhat beyond the depth of the groovelike indentations 21, and these housings are seated on a common, formed-on, continuous base part 2*b*, which in cross section is equivalent to that of FIG. 3.

Depending on the design and embodiment of the electrical apparatus or apparatus system to be connected, the clamping terminal arrangement may also be an integrated part of this apparatus or apparatus system. One example of this is shown in FIG. 12: A lamp socket 35 for a rod-shaped gas discharge lamp has a formed-on plastic fastening foot 36, in which the two housings 12 of two clamping terminals, designed fundamentally in accordance with FIGS. 1–7, are formed in. The groovelike indentations 21 of the two clamping terminal arrangements are aligned with their axes transversely to the longitudinal length of the gas discharge lamp to be inserted into the lamp socket 35. Their basic structure is equivalent to FIGS. 1–7 and will therefore not be described again here.

The new clamping terminal arrangement is designed in particular for suitability for automation, that is, to permit automatic direct wiring. This will be explained below in conjunction with FIGS. 13, 14:

In automatic direct wiring, a line-laying tool, and only part of which is shown schematically at 37, is moved for instance by a program-controlled industrial robot, not shown in further detail, along predetermined paths above a preassembled electrical apparatus that is to be wired; these paths correspond to the line-laying courses and extend between the various terminals of the electronic components. Each of these terminals has a clamping terminal arrangement approximately of the type shown in FIG. 1; it is suggested in FIGS. 13, 14 by the top of its housing 1, corresponding to the view of FIG. 5. The line-laying tool 37 has on its underside a rigid line-laying prong 38 of rectangular cross section, whose width at right angles to the plane of the drawing, with the requisite play for motion, is equivalent to the width 23 of the groovelike indentation 21 (see FIG. 7). A line guide conduit 39 is formed in the laying prong 38, and the electric line, drawn endlessly from a coil or the like via a feed mechanism is supplied to this conduit, which opens at 41 in a vertical side face 40 in such a way that the segment of the line 24 emerging from the mouth 41 is aligned horizontally in the manner visible in FIG. 13.

Laterally spaced apart from the flat side face 40 and aligned parallel to it, a ram 42 is provided, which is supported so as to be raised and lowered on the line-laying tool 36 and which can be supported by a pressure face 43 on the horizontal segment of the line 24 protruding from the mouth 41. Thus this segment is securely supported on the one hand on the pressure face 43 and on the other on the upper boundary of the line guide conduit 39 in the region of its mouth 41.

An interstice 44 is defined between the ram 42 and the side face 40; its width is equal to or somewhat greater than the width of the pair of ribs 8 of the housing 1. The ram 42 itself has a rectangular cross section. Its width at right angles to the plane of the drawing corresponds in the present case, including the necessary play for motion, to the width of the introduction slit 10; however, it may also be chosen to correspond to the width 23 of a groovelike indentation 21.

In automatic direct wiring, the line-laying tool 31 is positioned by the industrial robot, in cooperation with sensing means, precisely positionally correctly above the housing 12 of the clamping terminal arrangement of a terminal, so that the entire system assumes the position shown in FIG. 13, in which the ram 42 is in its advanced support position.

Figure 14:
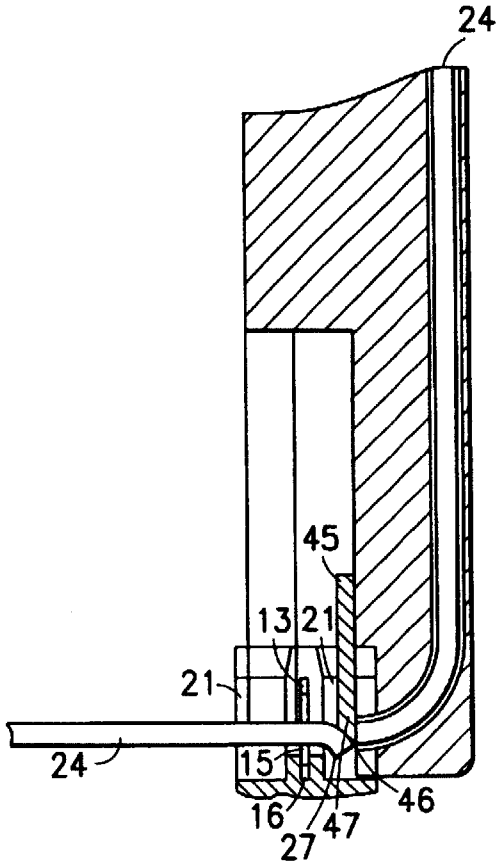

The line-laying tool 37 is now moved vertically downward with its laying prong 38, and the laying prong 38 moves from above into the right-hand groovelike indentation 21 in the manner visible in FIG. 14, which at the same time the ram 42 slides into the left-hand groovelike indentation 21 and partway into the introduction slit 10. The IPC contact 16 comes to rest in the interstice 44 between the side face 40 and the ram 42.

In this downward motion of the line-laying tool 37, the line segment, held exactly and supported between the pressure face 43 and the top of the mouth 41 at two points on both sides of the IPC contact 16, is pressed from above through the introduction slit 10 into the IPC slit 14 until it enters the enlarged portion 12 (FIG. 5) and is locked therein in detent fashion. Perfect contacting of the electrical conductor 26 at the IPC contact 16 is thus produced, while the electric insulation 25 of the line 24 is clamped laterally and thus fixed between the opposed ribs 8 in the introduction slit 10. The line 24 is therefore not only contacted in a gas-tight fashion but also fixed in a tension-relieved manner at its insulation 25 (see FIG. 16).

In this introduction motion of the line 24 into the introduction slit 10 and the IPC slit 14, the groovelike indentation 21 assures a perfect exact lateral association of the laying prong 38 and the ram 42 with the two aforementioned slits. Small errors in assembly of the clamping terminal arrangement are compensated for automatically by the introduction bevels 22. The side faces of the indentation 21 act as guide faces.

If the line 24 is to be merely through-wired at the terminal, that is, laid continuously through the terminal, then after the line 24 has been introduced into the introduction slit 10 and the conductor 26 has been contacted in the IPC slit 14, the ram 42 is merely moved upward into a remote position of repose in the line-laying tool 37, whereupon the industrial robot moves the line-laying tool 37 with its laying prong 38 along a preprogrammed path to the next terminal, with a similarly designed clamping terminal arrangement that is triggered in accordance with FIG. 13. During this displacement motion of the line-laying tool 36, the requisite line length is supplied synchronously with the displacement motion via the line guide conduit 39.

However, if the line 24 is to be clipped at the terminal, then as one alternative IPC contacts corresponding to FIG. 9 may be provided at this terminal, at whose clipper edge 28 the ram 42 clips the conductor 26 after the contacting by simply pressing it onto the clipper edge 28. As another alternative, however, a controlled clipper blade 45 may be used for this purpose on the line-laying tool 37, and this blade is then supported on the side face 40 such that it can be raised and lowered and can be moved forward with its clipper edge 46 out of the position of repose shown in FIG. 13 into a clipping position shown in FIG. 14, in which the clipper edge 46 has overtaken the mouth 41, thereby severing the line 24.

The clipper blade 45 is formed such that there is space for it in the groovelike indentation 21 of the housing 1. Adjoining the clipper edge 46, it has an oblique face 47, which in the clipping process bends the line end 27, firmly clamped in the introduction slit 10 by the insulation 25, downward by almost 90°, so that the exposed metal cut face of the conductor 26 is oriented substantially toward the bottom of the indentation 21, as illustrated in FIGS. 14 and 15.

Once the line 24 has been clipped, the clipper blade 45 and the ram 42 are returned to their position of repose; the line-laying tool 37 moves away from the terminal, whose clamping terminal arrangement is in the situation shown in FIG. 15.

Since the depth, width and length of the groovelike indentation 21 are selected such that the cut face of the metal conductor 26 cannot be accidentally touched from outside, then once the clipping operation shown in FIG. 14 is completed, the line end 27 is automatically assured to be protected at the terminal against shock hazard; no further provisions are required to achieve this.

If a clamping terminal arrangement in the version of FIG. 8 is used, then the clipped line end 27 comes to rest in the chamberlike indentation 21, in which it is again protected against shock hazard, but at the same the clamping terminal arrangement can be formed with a shorter structural length. Moreover, two lines can be contacted from both sides.

We claim:

1. An electrical clamping terminal arrangement for automatic wiring by means of a line laying tool having a housing (1) of insulating material, which has at least one introduction slit (10), open at the edge toward an introduction side, for receiving an insulated electrical line (24), and at least one insulation piercing connector (IPC) terminal (16), located in a shock-hazard-proof manner in the housing (1) and forming a contacting zone, with an IPC slit (14) open at an introduction edge and aligned with the introduction slit (10) for connecting conductors, wherein the housing (1, 1*a*) is formed with a slit-like or groove-like indentation or recess (21) open toward the introduction side, on at least one side, outwardly with respect to the IPC terminal, and in alignment with the introduction slit (10), said slit-like or groove-like indentation or recess (21) having a width which is greater than the width of the introduction slit (10), adjoining at one of its ends the introduction slit and, at its other end, facing away from the introduction slit (10) towards the outside of the housing, said housing (1) further including means for guiding or centering said line laying tool relative to the IPC slit (14) when said electrical line (24) is being introduced into and contacted in said IPC slit (14), said guide means comprising guide faces formed on said slit-like or groove-like indentation or recess (21);

said open indentation or recess (21) being dimensioned to receive an end portion of said line-laying tool and to receive and locate a free, optionally cut, end (27) of the line (24) contacted in the IPC terminal in a shock-hazard-proof manner.

2. The clamping terminal arrangement of claim 1, characterized in that the slitlike or groovelike indentation or recess (21) is provided on the introduction side with a widened portion (12).

3. The clamping terminal arrangement of claim 1, characterized in that the housing (1, 1*a*) has formed-on attachment means (3).

4. The clamping terminal arrangement of one of claim 1, characterized in that the housing (1) is formed onto a part (36) of an electrical circuit element (35).

5. The clamping terminal arrangement of claim 1, wherein the line (24) is received in the introduction slit (10) by a press-in or interference fit.

6. The clamping terminal arrangement of claim 1, characterized in that the slitlike or groovelike indentation or recess (21) is formed as a chamber.

7. The clamping terminal arrangement of claim 6, characterized in that the chamber is defined on both sides by IPC terminals (16), each with an associated introduction slit (10).

8. The clamping terminal arrangement of claim 1, characterized in that it includes at least one line cutting (28) for the line (24) to be pressed into the IPC slit (14).

9. The clamping terminal arrangement of claim 1, characterized in that the line cutting (28) is formed on the IPC terminal (160).

10. The clamping terminal arrangement of claim 1, characterized in that the introduction slit (10) has a width that brings about a clamping fixation of the line (24).

11. The clamping terminal arrangement of claim 1, characterized in that the introduction slit (10) has a width which, upon placing the line in that slit, clamps the line in the slit.

12. The clamping terminal arrangement of claim 3, characterized in that it includes at least one clipper edge (28) for a line (24) to be pressed into the IPC slit (14).

13. The clamping terminal arrangement of claim 9, wherein the line (24) is received in the introduction slit (10) by a press-in or interference fit.

14. The clamping terminal arrangement of claim 11, characterized in that it includes at least one clipper edge (28) for a line (24) to be pressed into the IPC slit (14).

15. The clamping terminal arrangement of claim 9, characterized in that it includes at least one clipper edge (28) for a line (24) to be pressed into the IPC slit (14).

16. The clamping terminal arrangement of claim 5, characterized in that it includes at least one clipper edge (28) for a line (24) to be pressed into the IPC slit (14).

* * * * *